US009060550B2

(12) United States Patent
Conrad

(10) Patent No.: US 9,060,550 B2
(45) Date of Patent: Jun. 23, 2015

(54) ATHLETIC WEAR WITH HIDDEN POCKETS

(71) Applicant: Christina Conrad, Palm Beach, FL (US)

(72) Inventor: Christina Conrad, Palm Beach, FL (US)

( * ) Notice: Subject to any disclaimer, the term of this patent is extended or adjusted under 35 U.S.C. 154(b) by 0 days.

(21) Appl. No.: 13/891,144

(22) Filed: May 9, 2013

(65) Prior Publication Data

US 2013/0303052 A1 Nov. 14, 2013

Related U.S. Application Data

(60) Provisional application No. 61/645,248, filed on May 10, 2012, provisional application No. 61/732,340, filed on Dec. 1, 2012.

(51) Int. Cl.
*A41C 3/00* (2006.01)

(52) U.S. Cl.
CPC ..... *A41C 3/0057* (2013.01); *A41C 3/0035* (2013.01)

(58) Field of Classification Search
CPC ... A41D 27/20; A41D 27/205; A41D 27/208; A41D 13/0012; A41C 3/0014; A41C 3/0035; A41C 3/0057
USPC ..... 450/89, 1; 2/247–254
See application file for complete search history.

(56) References Cited

U.S. PATENT DOCUMENTS

| | | | | |
|---|---|---|---|---|
| 4,034,417 | A * | 7/1977 | Ellis | 2/81 |
| 4,076,881 | A * | 2/1978 | Sato | 428/195.1 |
| 4,174,717 | A | 11/1979 | Schreiber et al. | |
| 4,699,144 | A * | 10/1987 | Sherwood | 450/54 |
| 4,798,557 | A * | 1/1989 | Scott | 450/31 |
| 5,690,537 | A * | 11/1997 | Kalmus | 450/57 |
| D448,541 | S * | 10/2001 | Robinson | D2/706 |
| 7,364,491 | B2 * | 4/2008 | Updyke | 450/89 |
| 7,396,784 | B2 * | 7/2008 | Thiriot | 442/303 |
| 7,585,200 | B1 | 9/2009 | McLaren | |
| 7,753,759 | B2 * | 7/2010 | Pintor et al. | 450/89 |
| D646,461 | S * | 10/2011 | Lewando | D2/708 |
| 8,083,693 | B1 * | 12/2011 | McKeon et al. | 600/594 |
| 2008/0032600 | A1 * | 2/2008 | Updyke | 450/89 |
| 2009/0104845 | A1 * | 4/2009 | Pintor et al. | 450/31 |
| 2011/0244758 | A1 * | 10/2011 | Boatright et al. | 450/89 |
| 2013/0288569 | A1 | 10/2013 | Gentry et al. | |

OTHER PUBLICATIONS

Wlkipedia (2014), available at: http://en.wikipedia.org/wiki/Durable_water_repellent.
https://www.gore.com/en_xx/products/fabrics/goretex/goretex_clothing.html.
http://www.nikwax-usa.com/en-us/products/productdetail.php?productid=273.
http://www.safetycomponents.com/WeatherMax/.
http://en.wikipedia.org/wiki/Sports_bra.

* cited by examiner

*Primary Examiner* — Gloria Hale

(74) *Attorney, Agent, or Firm* — Logue PC; Holly Logue; Elie Gendloff

(57) ABSTRACT

An article of clothing containing concealed pockets for storing and protecting smart phones, identification cards, credit cards, and other objects is provided. In some preferred embodiments, the article of clothing is sportswear or a sports bra.

22 Claims, 11 Drawing Sheets
(6 of 11 Drawing Sheet(s) Filed in Color)

ATHLETIC WEAR WITH HIDDEN POCKETS

CROSS REFERENCE TO RELATED APPLICATIONS

This application claims the benefit of U.S. Provisional Appln. No. 61/645,248, filed May 10, 2012, and U.S. Provisional Appln. No. 61/732,340, filed Dec. 1, 2012, each of which is hereby incorporated by reference in its entirety.

FIELD OF THE INVENTION

This invention relates generally to the field of brassieres, sports bras and athletic wear. In particular, the invention relates to sports bras and other athletic tops for women containing concealed pockets for storing and protecting cell phones, identification cards, credit cards, and other objects.

BACKGROUND

Electronic Dance Music (EDM) concerts, raves, and the club scene have become popular among teenagers and young adults. In these environments attendees often wear tight clothing that allows full body movement for dancing, such as mini-skirts, shorts, tank tops, bras, bikinis, bodysuits, body-hugging dresses and the like. While men's apparel, such as shorts, typically includes pockets for holding valuables, the same has not been true for women's fashions and particularly for the type of women's fashions found in the EDM/dance environment. Making things more difficult, because female attendees of these events are often dancing in close proximity with other people and using their hands in dance movements, carrying a purse is neither practical nor safe as the purse itself or items contained within the purse may be lost or easily stolen during dancing or other physical activities.

Brassieres with pockets are known in the art. See, e.g., U.S. Pat. Nos. 7,585,200 and 7,753,759, and U.S. patent application Ser. No. 13/074,302. However, none of these brassieres are appropriate for EDM concerts, raves, clubbing or intense exercise. First, female attendees of EDM events often wear as little clothing as possible while still being dressed appropriately. Most attendees would prefer to wear a tight, supportive tank top or sports bra or bikini top to a traditional bra. Second, traditional bras are often made of delicate fabrics such as lace and may contain unwire to support the breasts. These fabrics are not only uncomfortable, particularly on sweaty skin, but they can easily be damaged in a heavy dance environment. Further, underwire brassieres can poke into skin, causing irritation, and the underwire itself may break through the fabric under intense dance movement or other intense physical activity, destroying the brassiere and making the wearer extremely uncomfortable.

Finally, none of these pocketed brassieres prevent items from falling out of the pockets or protect items contained within them from heavy perspiration. This is particularly important for cell phones and other electronic devices as heavy sweating may damage or corrode the integrity of the device.

Thus, there is a need for a bra, for example, a sports bra, or sportswear with pockets that can hold and protect valuables such as cell phones, money, keys, cosmetics, credit cards, or other objects that women may wish to keep close to their body while dancing or performing some other physical activity, while allowing for a full range of movement for the wearer.

SUMMARY OF THE INVENTION

It is an object of the present invention to provide an article of clothing, such as a sports bra, tank top, bodysuit, dress or the like, which includes pockets to hold and protect personal belongings and can be worn during physical activity such as dancing, running, yoga or any other athletic or physical activity.

It is another object of the invention to provide, in some embodiments, an article of clothing, such as a sports bra, tank top, bodysuit, dress or the like, that includes water-resistant or water proof pockets to hold, secure and protect personal belongings from damage due to water or sweat.

It is a further object of the present invention to provide an article of clothing, such as a sports bra, tank top, bodysuit, dress or the like, that allows the wearer to experience a full range of movement while securing the wearer's personal items close to the body.

It is another object of the invention to provide, in some embodiments, an article of clothing, such as a sports bra, tank top, bodysuit, dress or the like, that includes a securing or closure means (for example, a zipper, flap, button, magnetic flap, hook and loop, or Velcro®) for a pocket to reduce or eliminate the possibility of objects falling from, or being unintentionally removed from, the pocket during physical activity, including dancing, jogging, tennis, or any other athletic or physical activity.

A method of protecting personal belongings and valuables during physical activity such as dancing, running, or yoga is also provided. The method comprises: placing the personal belonging or valuable into a pocket of an article of clothing of the present invention, and wearing said article of clothing.

Such method of protecting the personal belongings and valuables during heavy activity may further include securing such personal belonging or valuable in said pocket by any securing or closure means provided, such as a zipper, flap, button, magnetic flap, hook and loop, or Velcro®.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

This patent application file contains at least one photograph or drawing executed in color. Copies of this patent application publication with color drawing(s) will be provided by the Office upon request and payment of the necessary fee.

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

In FIG. 7, the wearer is shown inserting a smartphone into the pocket of the article of clothing.

In FIG. 8, a smartphone is shown secured by a closed zipper in the pocket of the article of clothing.

In FIG. 9, the pocket of the article of clothing is shown with an open zipper, allowing objects to be inserted or removed from the pocket.

In FIG. 10, the wearer is shown inserting a smartphone into the pocket of the article of clothing.

DETAILED DESCRIPTION OF THE INVENTION

The following description is exemplary in nature and is in no way intended to limit the scope of the invention as defined by the claims appended hereto. As will be apparent to one of skill in the art, modifications to described elements below may be made without deviating from the scope of the present invention.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Figure 1:
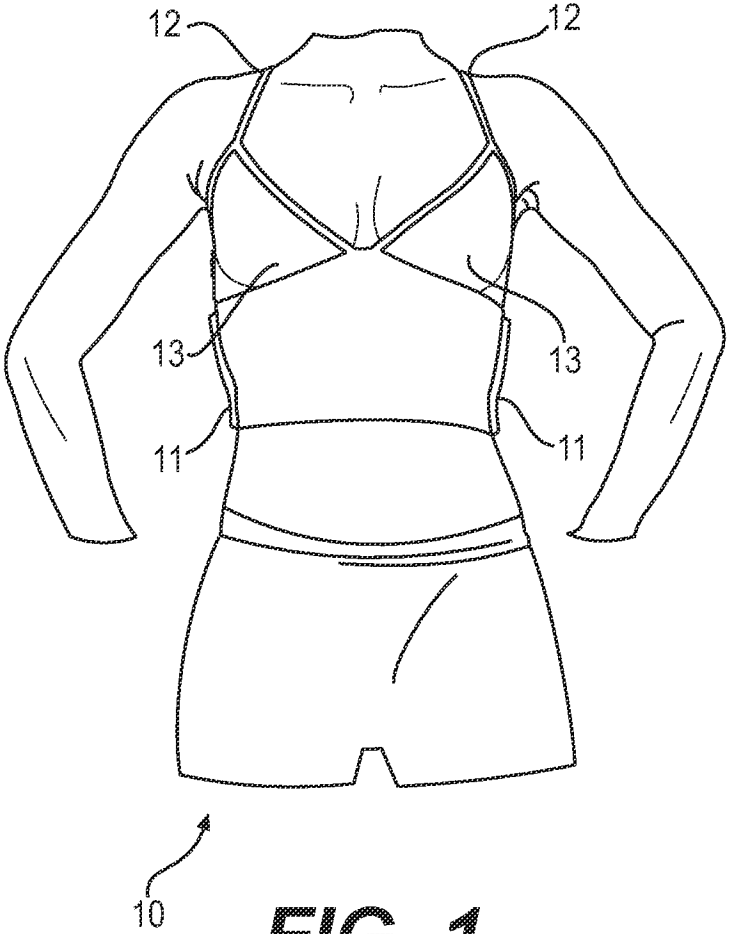
FIG. 1 is a front view of an embodiment of an article of clothing (e.g., a sports bra) of the present invention.
Figure 6:
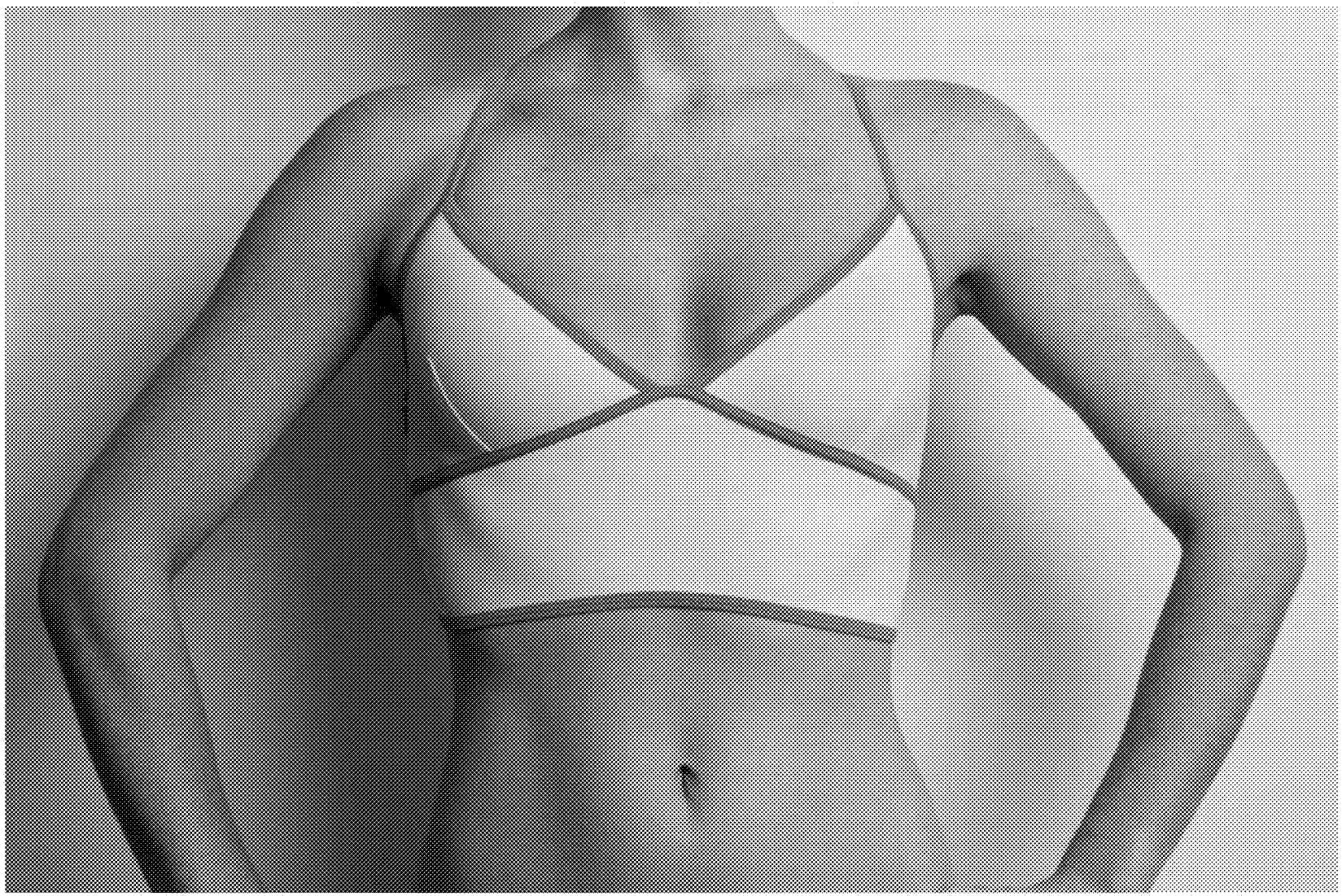
FIG. 6 is a color photo showing a front view of an embodiment of an article of clothing (e.g., a sports bra) of the present invention.
Figure 11:
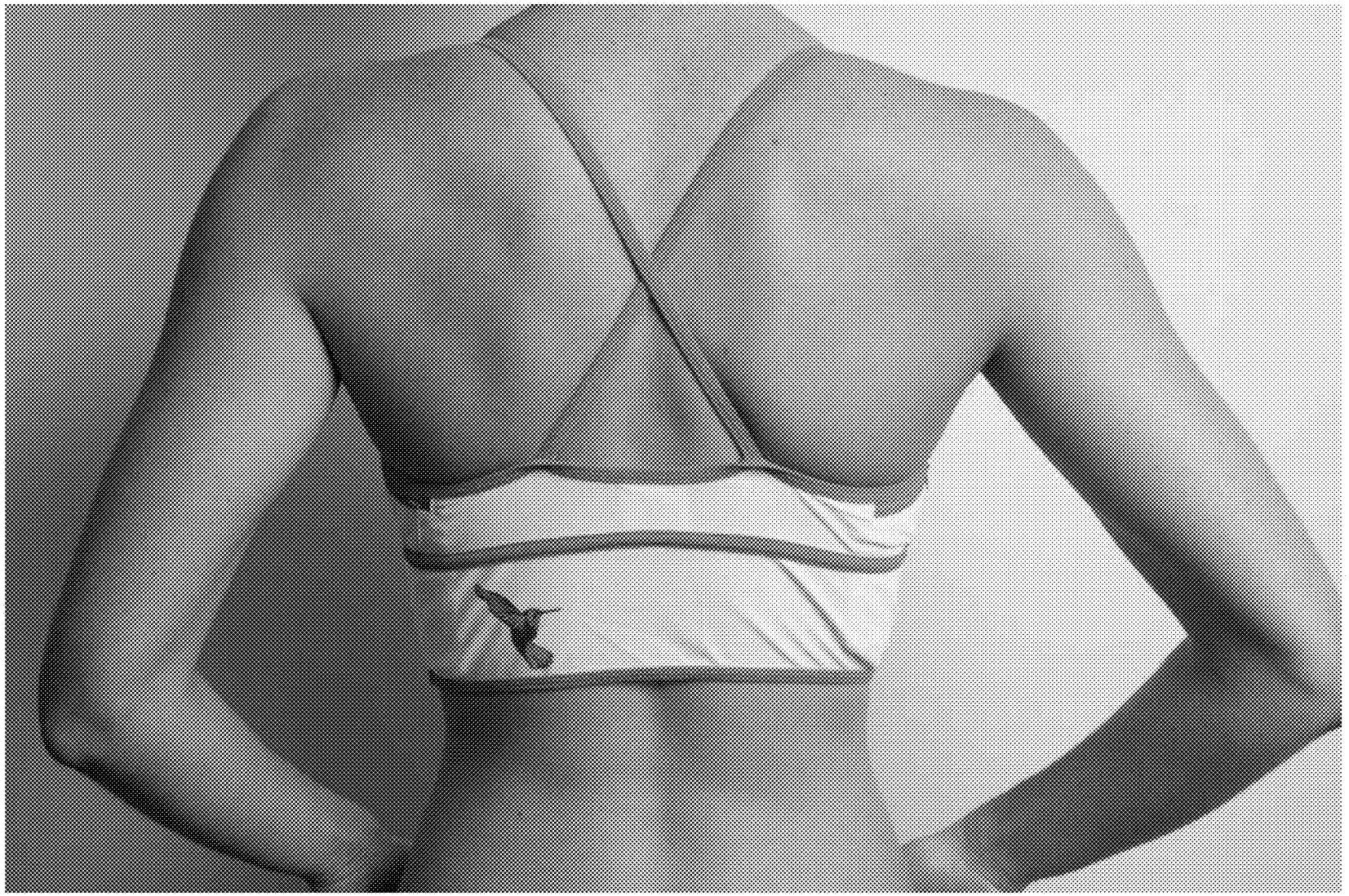
FIG. 11 is a color photo showing a back view of an embodiment of an article of clothing (e.g., a sports bra) of the present invention.

Referring to FIG. 1, an example of an article of clothing of the present invention 10 is shown. In this embodiment, the article of clothing is a sports bra. In FIG. 1, the pockets 11 of the sports bra are shown as extending out from the article of clothing 10 to enhance clarity of the invention, however in an actual embodiment of the invention the pockets 11 would preferably be sewn into the side of the article of clothing 10 and virtually invisible as shown in FIGS. 6 and 11. Further, there need not be two pockets in the article of clothing 10, as shown in the figures, but the article of clothing 10 may contain one, two, three, four, or as many pockets as may be desired.

Figure 2:
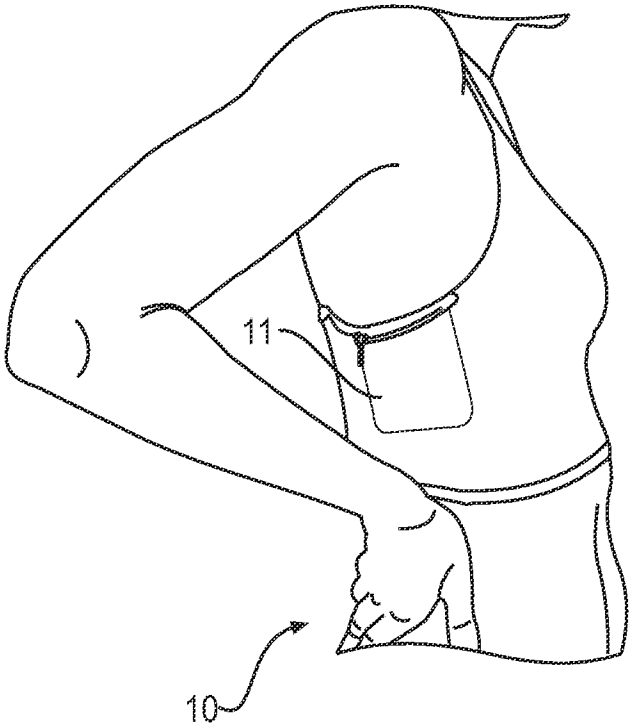
FIG. 2 is a side view of an embodiment of an article of clothing of the invention (e.g., a sports bra) showing one of the preferred embodiments of the invention wherein a pocket is positioned on the side of the chest beneath the armpit of the wearer.

In FIG. 1, the pockets 11 are shown positioned below the breast portion 13 of the sports bra, however, the pockets 11 may be positioned anywhere on the article of clothing 10. Another preferred embodiment of the invention, for example, includes pockets 11 that are positioned directly to the side of the breast portion 13 of the article of clothing, as shown in FIGS. 2 and 6 though 11.

Figure 4:
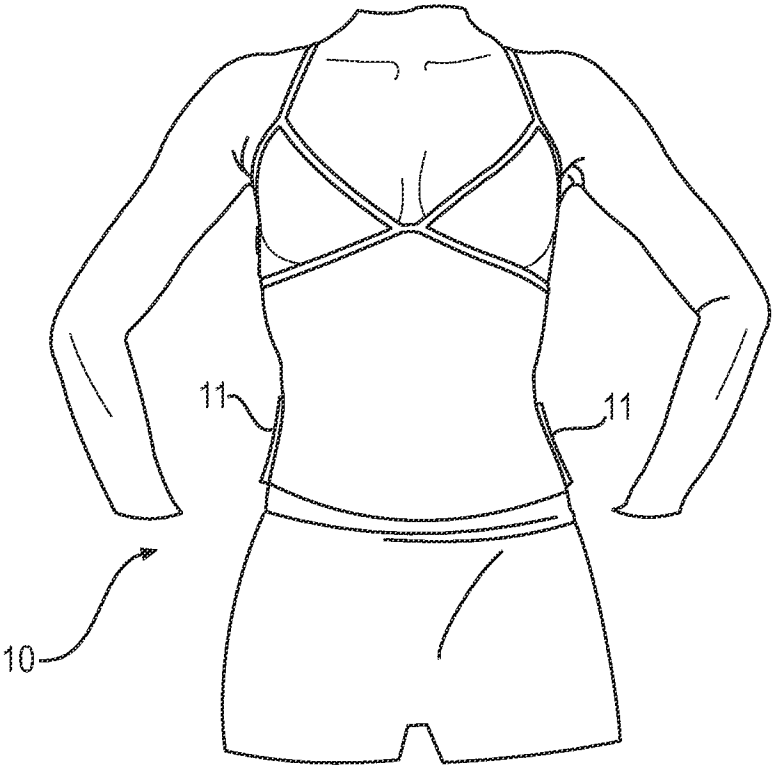
FIG. 4 is an alternative embodiment of an article of clothing of the present invention wherein the article of clothing is a supportive tank top and the pocket or pockets for holding personal belongings and valuables, in a preferred embodiment, may be positioned anywhere along the side of the body, from beneath the armpit to the waist.

The article of clothing 10 may have straps 12 on the shoulders that hold the article of clothing 10 in place. The portion of the article of clothing 10 that covers the breasts 13 may, in some embodiments, have multiple layers of fabric for comfort, additional support or modesty. Preferably, the article of clothing 10 does not utilize any underwire underneath the breast portion 13 as underwire tends to be uncomfortable, may poke the wearer and prevents full movement of the body during dancing, exercise or other physical activities. Then article of clothing 10 may stop just below the breasts, as shown in FIG. 1, or extend toward or beyond the belly button, as shown in FIG. 4.

The article of clothing 10 may be made from a variety of materials, including natural fabrics (e.g., cotton, cotton blends, wool, linen), or synthetic breathable materials (e.g., nylon, nylon blends), and the like. In one preferred embodiment, the pockets 11 of the article of clothing 10 are made from a water absorbing material such as cotton or a blend thereof. In another preferred embodiment, the pockets 11 of the article of clothing 10 are made from a water-resistant/sweat resistant material, for example, nylon, spandex (or a blend thereof), a fluoropolymer fabric (for example, polytetrafluoroethylene (PTFE)), vinyl, latex, neoprene, polyurethane, mesh fabric, polyester or any similar material, blend of or combination of the foregoing. In another embodiment, the entire article of clothing 10 is made from a water-resistant/sweat resistant material. The article of clothing 10 may comprise one or more layers of material.

Further, the inside (not shown) of the pockets 11 of the article of clothing 10 of the present invention may be treated with a water resistant material, for example, silicone, which term includes silicone analogues and derivatives, including but not limited to siloxanes (e.g., dimethylsiloxanes, polydimethylsiloxanes, etc.) and silicones (e.g., amino functional silicones, methyl hydrogen silicones, epoxy and hydroxy functional silicones, silicone polyethers, etc.), and may include any mixture of a silicone (with other silicones or other compounds). In one example, the silicone is a silicone sealant or adhesive, such as Liquid Nails® Clear Small Projects Silicone Adhesive (information available at: www.liquidnails.com/products/product.jsp?productId=74) and Liquid Nails® Silicone Premium Universal Sealant (information available at: www.liquidnails.com/products/product.jsp?productId=13&d#details). Such treatment helps to prevent sweat or water from permeating into the cavity of the pockets, thus protecting valuables (particularly electronic devices) from exposure.

In other embodiments, the pockets 11 of the article of clothing 10 may be made of a textile with a microporous Teflon membrane backing, GORE-TEX®, a textile treated with NikWax PolarProof (see, e.g., www.seattlefabrics.com/nikwax.html), a textile treated with a Durable Water Repellent (DWR) finish, a textile with a HydroMAX finish, or any textile treated with any other type of finish that provides any level of water-resistant properties.

In yet another embodiment of the invention, the inside of the pockets 11 of the article of clothing 10 of the present invention may be treated with an "energy textile" that allows a cell phone or other electronic device to charge while in the pocket. See, for example, www.wired.com/gadgetlab/2010/01/e-textile-charge/ and Bao, Lihong et al., *Towards Textile Energy Storage from Cotton T-Shirts*, Advanced Materials, Vol. 24, Issue 24, pp. 3246-3352 (Jun. 26, 2012) (available at http://onlinelibrary.wiley.com/doi/10.1002/adma.201200246/abstract;jsessionid=57635F550AFF14F218B22714C99ABEDC.d03t03).

Figure 7:
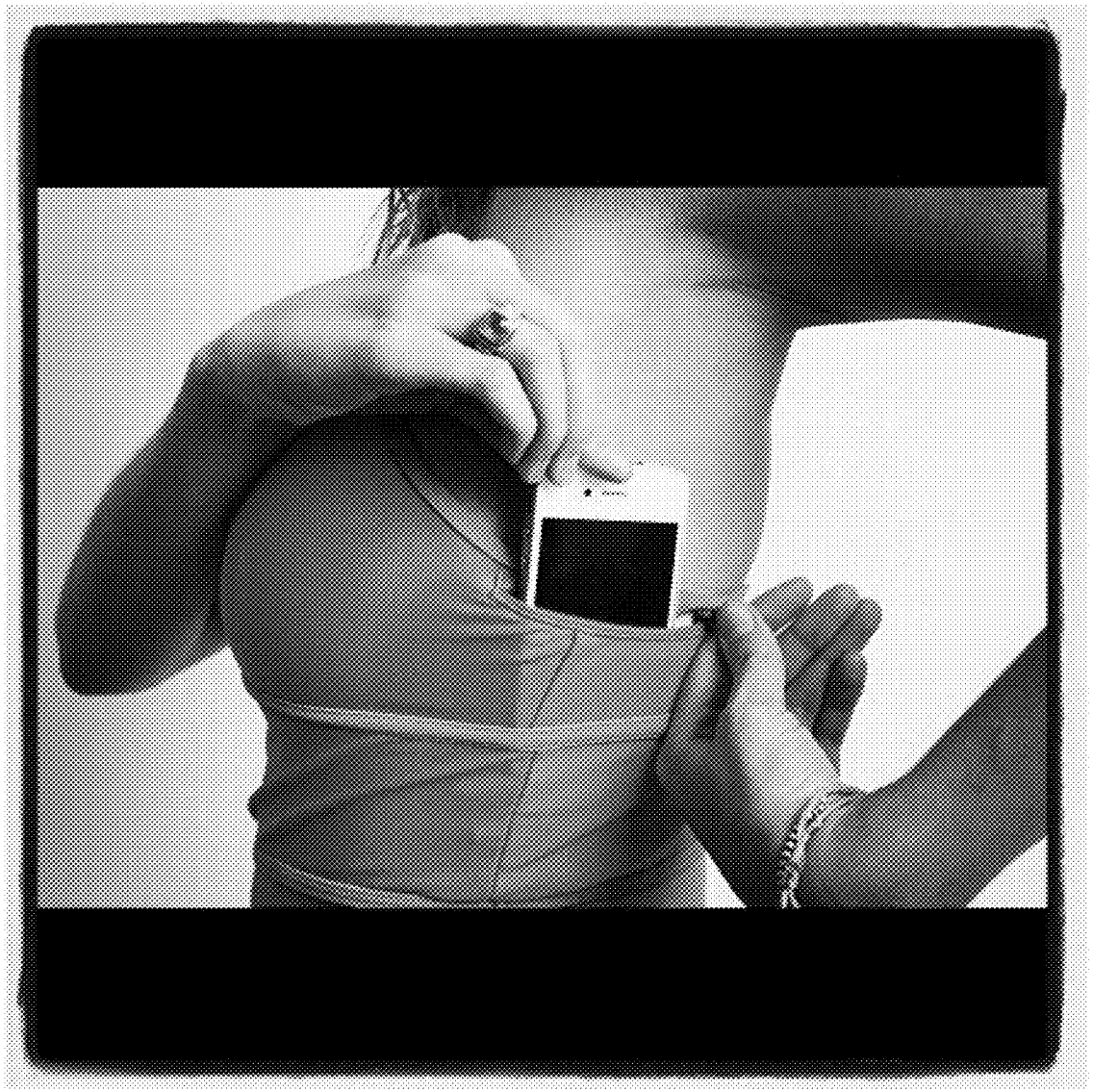
FIG. 7 is a color photo showing a side view of an embodiment of an article of clothing (e.g., a sports bra) of the present invention. In one of the preferred embodiments of the invention, a pocket is positioned on the side of the chest beneath the armpit of the wearer.
Figure 8:
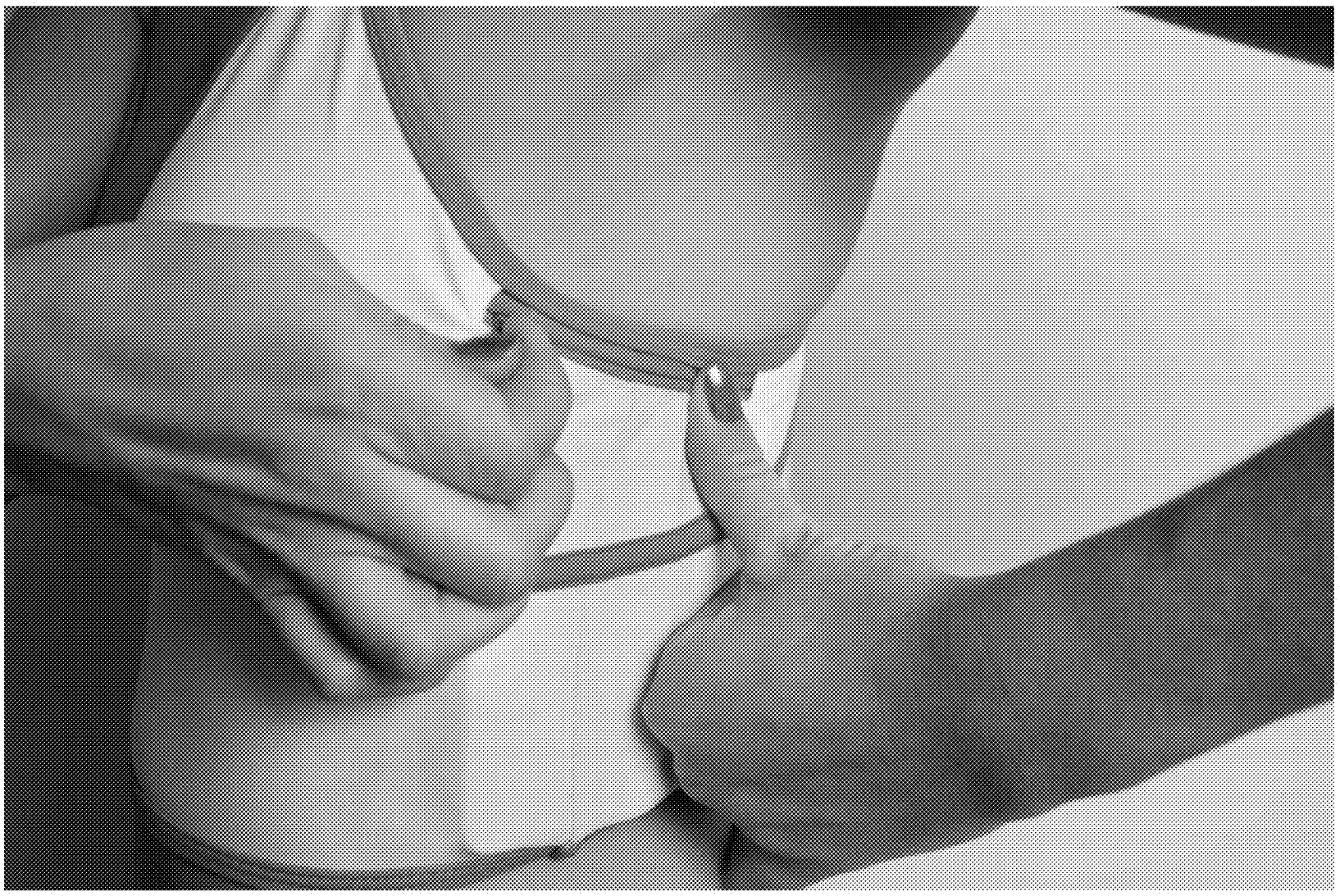
FIG. 8 is a color photo showing a side view of an embodiment of an article of clothing (e.g., a sports bra) of the present invention.
Figure 10:
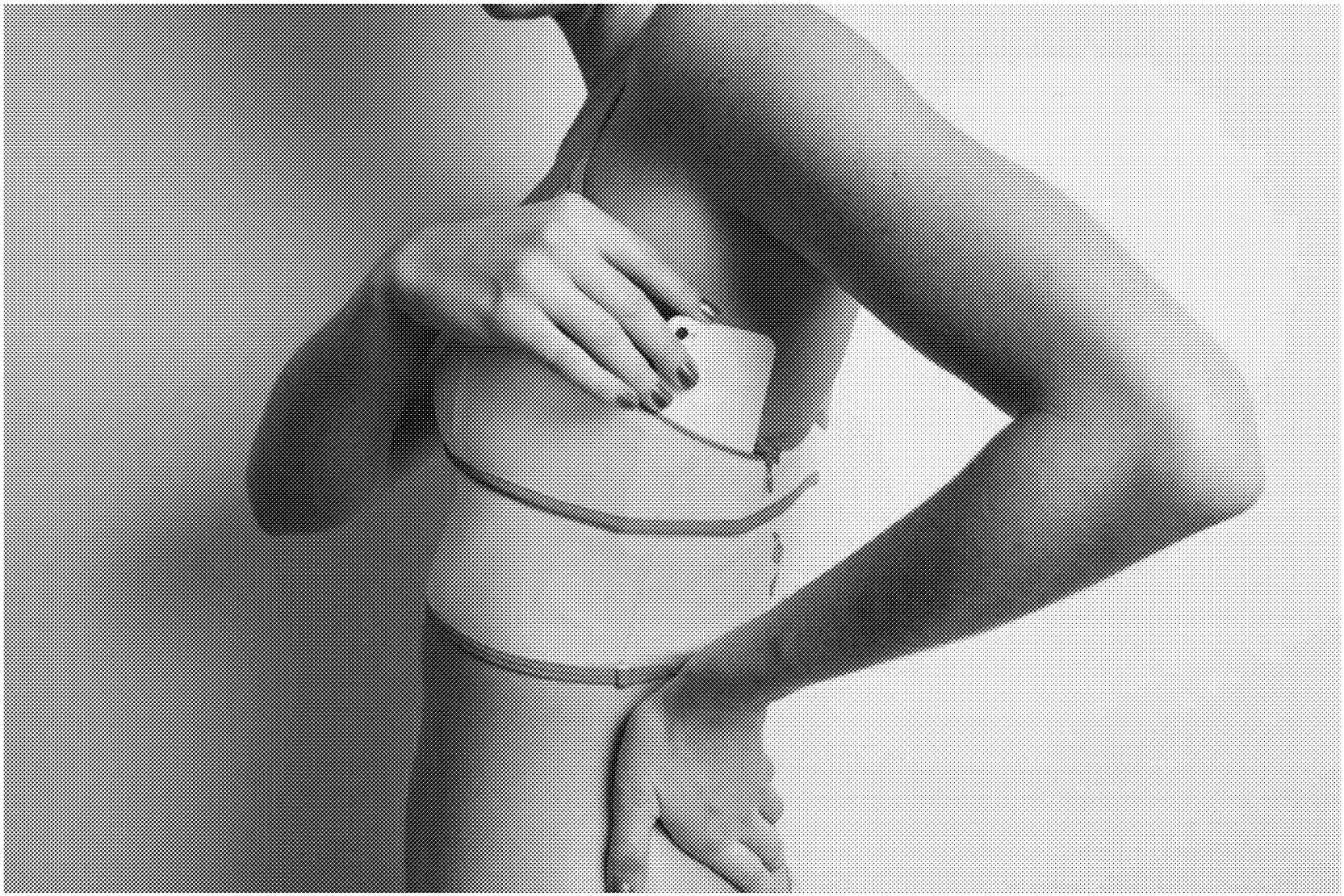
FIG. 10 is a color photo showing an alternate side view of an embodiment of an article of clothing (e.g., a sports bra) of the present invention.

FIG. 2 shows a side view of an article of clothing 10 of the present invention. In this embodiment, a pocket 11 is shown as a rectangle, however a pocket 11 may be any shape, including, for example, rounded, square or a horizontal or vertical rectangle as shown in FIGS. 7, 8 and 10. A pocket 11 may also be any size desired. For example, in the embodiment shown in FIGS. 7, 8 and 10, the pocket 11 is large enough to accommodate a smartphone.

Figure 3:
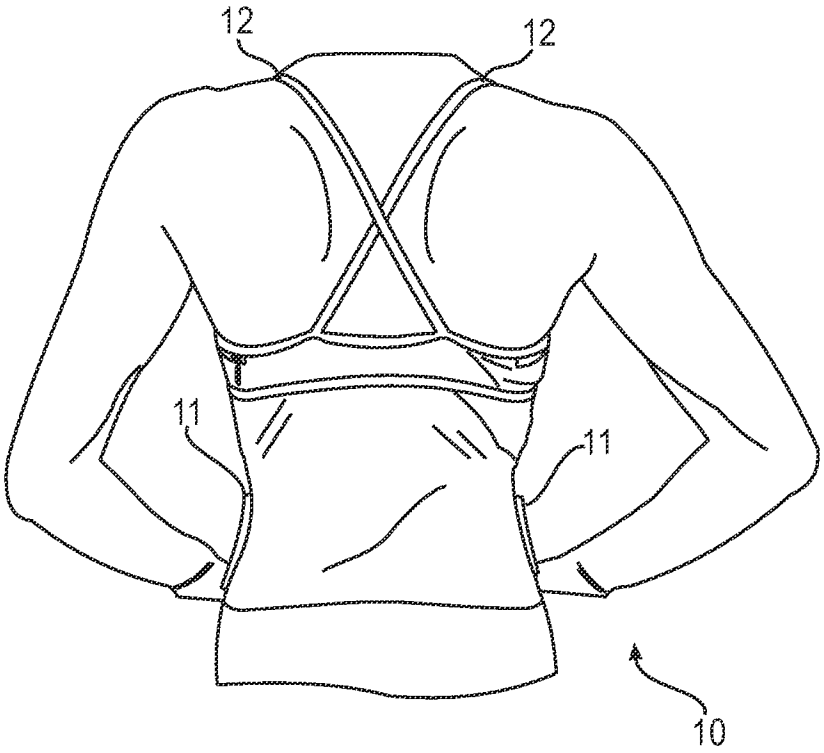
FIG. 3 is back view of an embodiment of an article of clothing (e.g., a sports bra or a supportive tank top) of the present invention.

FIG. 3 shows a back view of the article of clothing 10 of the present invention. As discussed above with respect to FIG. 1, the pockets 11 are shown as extending out from the article of clothing 10 to enhance clarity of the invention, however in an actual embodiment of the invention the pockets 11 would preferably be sewn into the side of the article of clothing 10 and virtually invisible as shown in FIG. 11. In the embodiment shown in FIG. 3, the pockets 11 are shown positioned at the waist of the wearer, however, as discussed above, the pockets 11 may be positioned anywhere on the article of clothing 10. Another preferred embodiment of the invention, for example, includes pockets 11 that are positioned directly to the side of the breast portion 13 of the article of clothing, as shown in shown in FIGS. 2, and 6 though 11.

In the embodiment shown in FIG. 3, the straps 12 are shown crossing over each other, however other arrangements of the straps are contemplated. For example, the straps may be parallel in the back (as shown in FIG. 1 for the front of the article of clothing 10) or the straps may tie around the neck of the wearer.

FIG. 4 provides another embodiment of the article of clothing 10 of the present invention. In this figure, the article of clothing is a tank top and the pockets 11 are shown placed at the waist of the wearer, however, the pockets 11 may be located anywhere on the article of clothing 10, for example, along the side of the article of clothing extending from the waist to the armpit. Other embodiments of the article of clothing 11 of the present invention include body suits, swimwear, dresses or the like.

Figure 5:
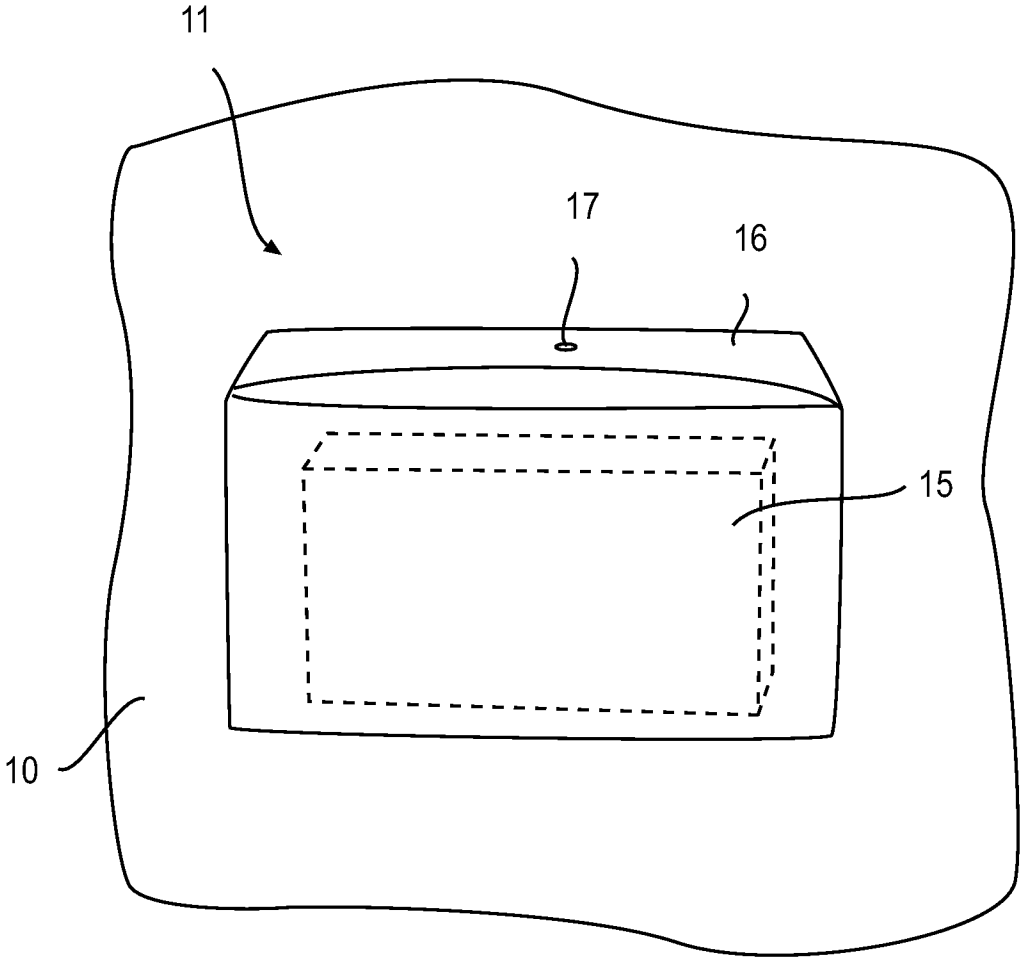
FIG. 5 is a detail of a pocket of the present invention showing a closure or securing means, for example, a zipper or a flap.
Figure 9:
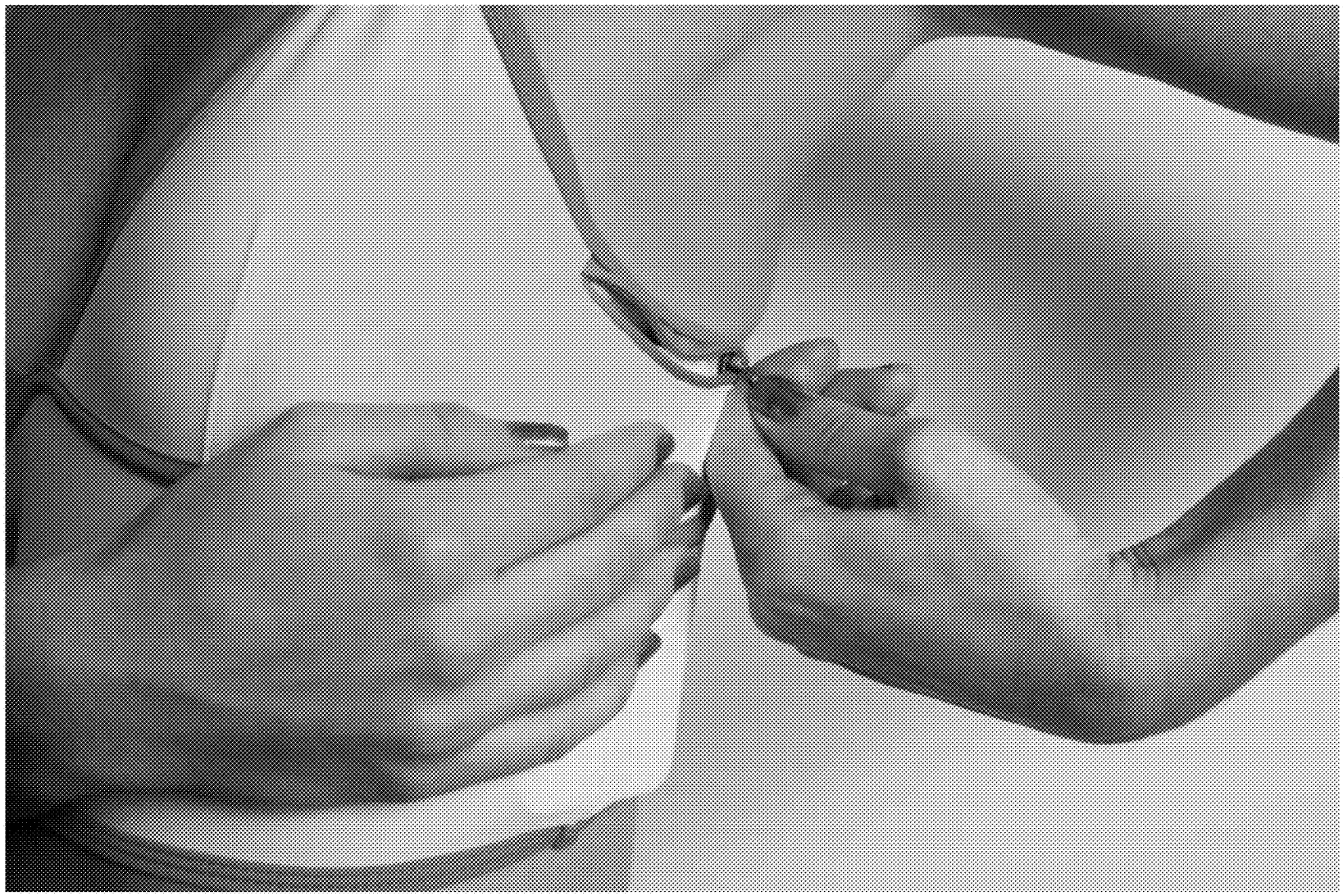
FIG. 9 is a color photo showing a side view of an embodiment of an article of clothing (e.g., a sports bra) of the present invention.

FIG. 5 provides a cross section close up view of a pocket on the invention. In FIG. 5, a pocket 11 is shown as a horizontal rectangle (as opposed to a vertical rectangle shown in FIGS. 7 through 10) that can hold a smartphone 15 (outline shown by dotted line), however as discussed above, the size and shape of the pocket 11 may vary. The pocket 11 is shown in this embodiment with a flap 16 that may act as a closure means to protect valuables from being lost or stolen during physical activity. The flap 16 may use any securing/closure means known in the art, for example, a snap 17, buttons, hook and eye, magnetic strips, or Velcro®. In another embodiment, the securing/closure means may be a zipper, as shown in FIGS. 8 and 9.

The opening for the pocket 11 may be in any configuration desired, for example, as shown in FIGS. 5 and 10, the opening of the pocket 11 and the closure means are shown at the top of the pocket 11, however, these may be located at the sides of the pocket, beneath the pocket, or diagonally across the pocket, for example.

The contents of the articles, patents, and patent applications, and all other documents and electronically available information mentioned or cited herein, are hereby incorporated by reference in their entirety to the same extent as if each individual publication was specifically and individually indicated to be incorporated by reference. Applicants reserve the right to physically incorporate into this application any and all materials and information from any such articles, patents, patent applications, or other documents.

The inventions illustratively described herein may suitably be practiced in the absence of any element or elements, limitation or limitations, not specifically disclosed herein. Thus, for example, the terms "comprising", "including," containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the inventions embodied therein herein disclosed may be resorted to by those skilled in the art, and that such modifications and variations are considered to be within the scope of this invention as defined by the appended claims.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

All of the compositions, objects and methods disclosed and claimed herein can be made and executed without undue experimentation in light of the present disclosure. While the compositions, objects and methods of this invention have been described in terms of preferred embodiments, it will be apparent to those of skill in the art that variations may be applied to the compositions, objects and methods and in the steps of the sequence of steps of the method described herein without departing from the concept, spirit and scope of the invention. More specifically, it will be apparent that certain agents which are both chemically and physiologically related may be substituted for the agents described herein while the same or similar results would be achieved. All such similar substitutes and modifications apparent to those skilled in the art are deemed to be within the spirit, scope and concept of the invention as defined by the appended claims.

Other embodiments are set forth within the following claims.

What is claimed is:

1. An article of clothing for wearing in contact with the breasts of the wearer, comprising:

a front portion that covers the breasts of the wearer;

a back portion; and two side portions for connecting said front portion to said back portion, wherein the article of clothing provides support adequate to restrict breast motion during exercise, wherein said article of clothing comprises at least one pocket, wherein said at least one pocket is located on at least one of said two side portions and inwardly deposed so that the pocket cannot be seen when viewing the outside of the garment, wherein said side portions and said back portion comprise a single layer of fabric except for trim and said at least one pocket, wherein said at least one pocket is attached to a top of said at least one of said two side portions, and comprises an inner layer positioned to be directly in contact with the side of the breast of the wearer, and an outer layer positioned between said inner layer and said side portion of said article, and wherein said at least one pocket is positioned directly under the armpit and on the side of the breast of the wearer, wherein said article of clothing extends below the breasts toward the stomach, and wherein said article of clothing is selected from the group consisting of a sports bra, swim top, tank top, t-shirt, dress, and bodysuit.

2. The article of clothing of claim 1, wherein said article of clothing is made from a water resistant or water absorbing material.

3. The article of clothing of claim 2, wherein said at least one pocket is made from a water resistant or water absorbing material.

4. The article of clothing of claim 1, wherein said at least one pocket further comprises a closure.

5. The article of clothing of claim 4, wherein said closure is selected from the group consisting of a zipper, clasp, hook and eye, snap, magnetic flap, hook and loop, and button.

6. The article of clothing of claim 2, wherein said water resistant material is a silicone or a mixture of a silicone has been applied to the interior portion of said at least one pocket.

7. The article of clothing of claim 2, wherein said water resistant or water absorbing material is selected from the group consisting of cotton, nylon, spandex, a fluoropolymer fabric, vinyl, latex, neoprene, polyurethane, mesh fabric, polyester, and any blend or combination thereof.

8. The article of clothing of claim 1, wherein said at least one pocket has been treated with an energy textile.

9. The article of clothing of claim 1, wherein said at least one pocket is made of a textile with a microporous Teflon membrane backing, a breathable waterproof fabric, a textile treated with a fleece waterproofing spray, a textile treated with a Durable Water Repellent finish, or a textile with a water-repellent, mildew-resistant, breathable finish.

10. A method for protecting a personal belonging or valuable during physical activity, comprising:

placing said personal belonging or valuable in a pocket of the article of clothing of claim 1; and wearing said article of clothing.

11. The method of claim 10, wherein said method further comprises securing such personal belonging or valuable in said pocket by a closure means.

12. A method of charging a smart phone or other electronic device comprising:

placing said smart phone or other electronic device in a pocket of the article of clothing of claim 8; and wearing said article of clothing.

13. A sports bra comprising:

a front portion that covers the breasts of the wearer;

a back portion; and two side portions for connecting said front portion to said back portion, wherein said sports bra provides support adequate to restrict breast motion during exercise, wherein said sports bra comprises at least one pocket, wherein said at least one pocket is located on at least one of said two side portions, inwardly deposed, and secured to a top of said side portion directly beneath the armpit of a wearer, wherein said side portions and said back portion comprise a single layer of fabric except for trim and said at least one pocket, wherein said at least one pocket comprises an inner layer positioned to be directly in contact with the side of the breast of the wearer, and an outer layer positioned between said inner layer and said side portion of said sports bra, and wherein said at least one pocket is positioned directly under the armpit and on the side of the breast of the wearer, and wherein said article of clothing extends below the breasts toward the stomach.

14. The sports bra of claim 13, wherein said inner layer and said outer layer are further secured to the bottom of said side portion of said sports bra.

15. The sports bra of claim 13, wherein said inner layer and said outer layer have been treated with a water resistant material.

16. The article of clothing of claim 1, wherein said article of clothing is a tank top.

17. The sports bra of claim 13, wherein said at least one pocket further comprises a closure.

18. The sports bra of claim 13, wherein said inner layer and said outer layer are further secured to the side portion of the tank top at the bottom of said inner layer and said outer layer.

19. The article of claim 1, wherein said pocket is virtually invisible to a viewer of said article of clothing.

20. The sports bra of claim 13, said pocket is virtually invisible to a viewer of said sports bra.

21. The article of claim 1, wherein the article does not have a connector holding the back portion together.

22. The sports bra of claim 13, wherein the sports bra does not have a connector holding the back portion together.

* * * * *